US005788244A

United States Patent [19]

Hui et al.

[11] Patent Number: 5,788,244

[45] Date of Patent: Aug. 4, 1998

[54] ELECTRONIC DART BOARD

[75] Inventors: Lee Ping Hui, Tai-Pin; Conling Cho, No. 318, 8th Fl., Fushbng. Sec. 3, Taichung City, both of Taiwan

[73] Assignee: Conling Cho, Taichung, Taiwan

[21] Appl. No.: 645,746

[22] Filed: May 14, 1996

[51] Int. Cl.[6] ..... F41J 3/00

[52] U.S. Cl. ..... 273/374

[58] Field of Search ..... 273/371, 374

[56] References Cited

U.S. PATENT DOCUMENTS 5,486,007 1/1996 Stewart et al. ..... 273/374

*Primary Examiner*—William H. Grieb
*Attorney, Agent, or Firm*—Bucknam and Archer

[57] ABSTRACT

An electronic dart board, constituted essentially by a target frame (10) of ring-like shape with a plurality of display shields (11) on the front surface, passing through the target frame (10), and a plurality of fixing tabs (12) around the periphery; a plurality of target plates (30) inside the middle opening of the target frame (10), each of the target plates (30) having a press cover (31), a soft body (32) on the upper side of the press cover (31), a fish eye hole (34), passing through the middle of the press cover (31), a plurality of press bars (33), extending downwards from the lower side of the press cover (31), close to the periphery thereof; and a base plate (20), carrying the target frame (10) and, elastically, the target plates (30), of the press bars (33) of each target plate (30) pointing towards a touch-sensitive switch (23) on the base plate (20). The base plate (20) further has a plurality of illuminators (24), which are aligned with the display shields (11), such that the illuminators (24) are not covered by the target frame (10), and a plurality of fixing tabs (28), which are fastened to the fixing tabs (12) of the target frame (10).

3 Claims, 6 Drawing Sheets

ELECTRONIC DART BOARD

FIELD OF THE INVENTION

The present invention relates to a dart board and more particularly to an electronic dart board and particularly to an improvement of a conventional electronic dart board.

The term metal dart as used herein is intended to distinguish the electronic dart board set from traditional dart which is made of plastic.

The present invention with its metal dart may show the precise position and marks of each throwing.

SUMMARY OF THE INVENTION

Accordingly it is an object of this invention to overcome the disadvantages of the prior art.

More particularly, it is an object of the present invention to provide an improved dart board which comprises an elastic body with pressure cover.

BRIEF DESCRIPTION OF THE DRAWINGS

The invention can be more fully understood by reference to the following description and accompanying drawings, in which.

BACKGROUND OF THE PRIOR ART

Figure 1:
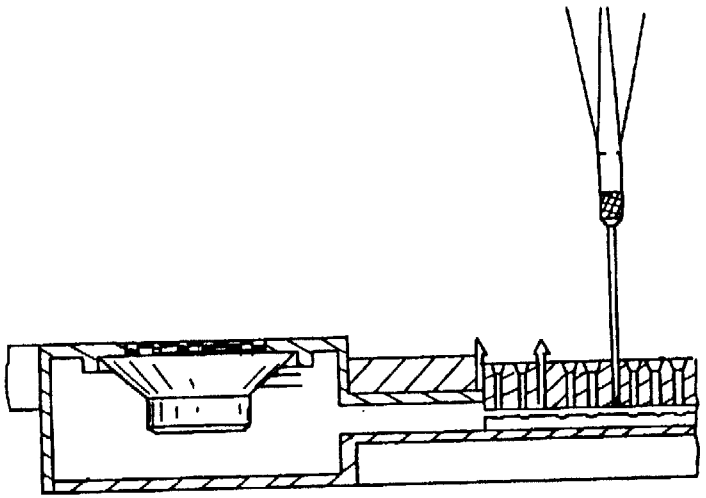
FIG. 1 PRIOR ART
FIG. 1 (prior art) is a sectional view of a conventional electronic dart board.

As shown in FIG. 1, a conventional electronic dart board has a surface with through holes. A dart hitting the surface is supposed to penetrate one of the holes and touch a membrane switch. A conventional electronic dart board, however, has several drawbacks. If the direction of incidence is not parallel to the through holes, the membrane switch at the end of the hole will not be touched. The probability of hitting the holes at the proper angle of incidence is low. Finally, the surface of a conventional electronic dart board is made of hard material, and the head of the dart is made of plastic, so that if the dart does not properly hit a hole, its head is easily deformed or even breaks. A dart with a deformed or broken head cannot be used again and has to be replaced.

DESCRIPTION OF THE PREFERRED EMBODIMENTS

Figure 2:
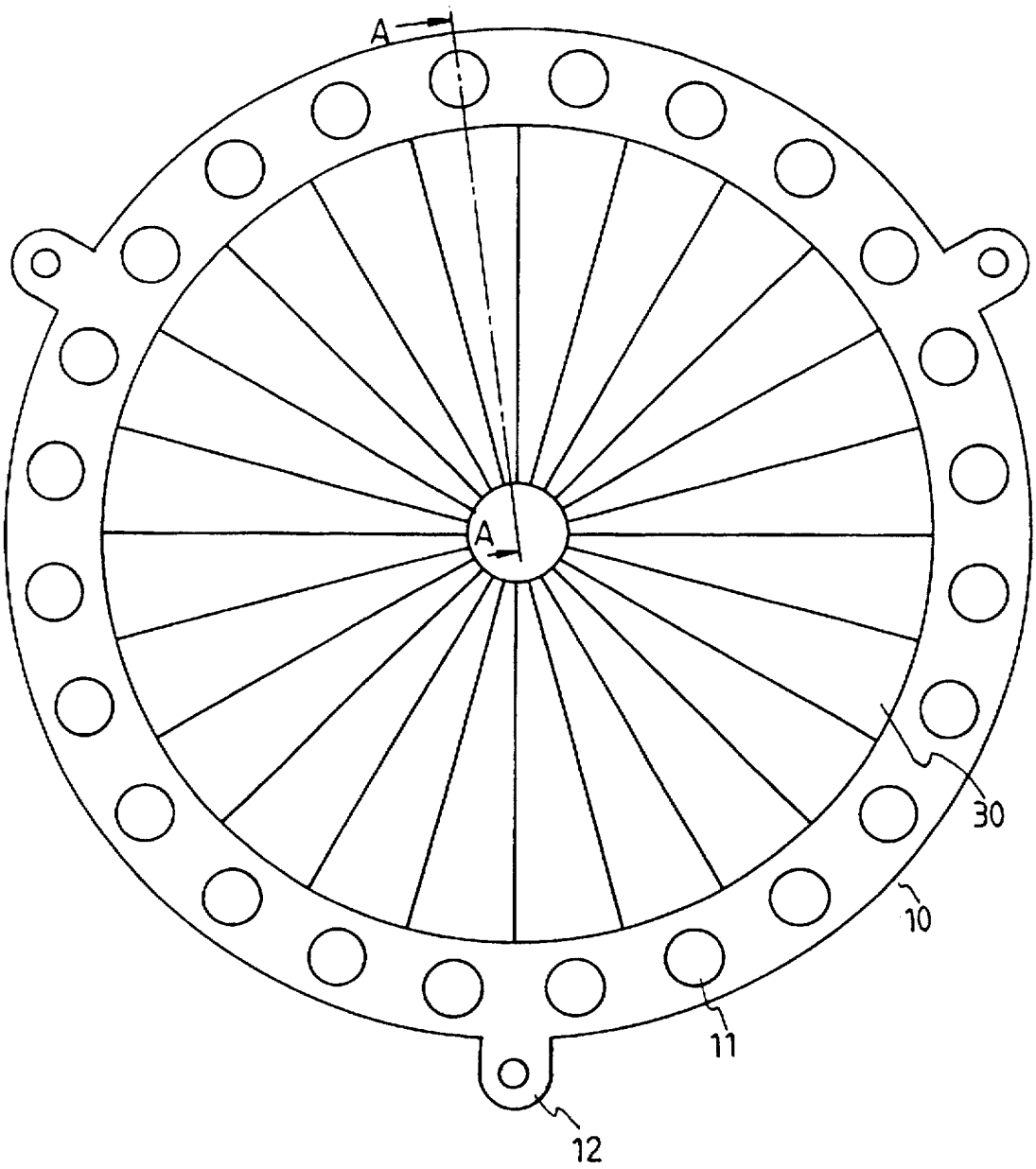
FIG. 2 is a front view of the electronic dart board of the invention.
Figure 3:
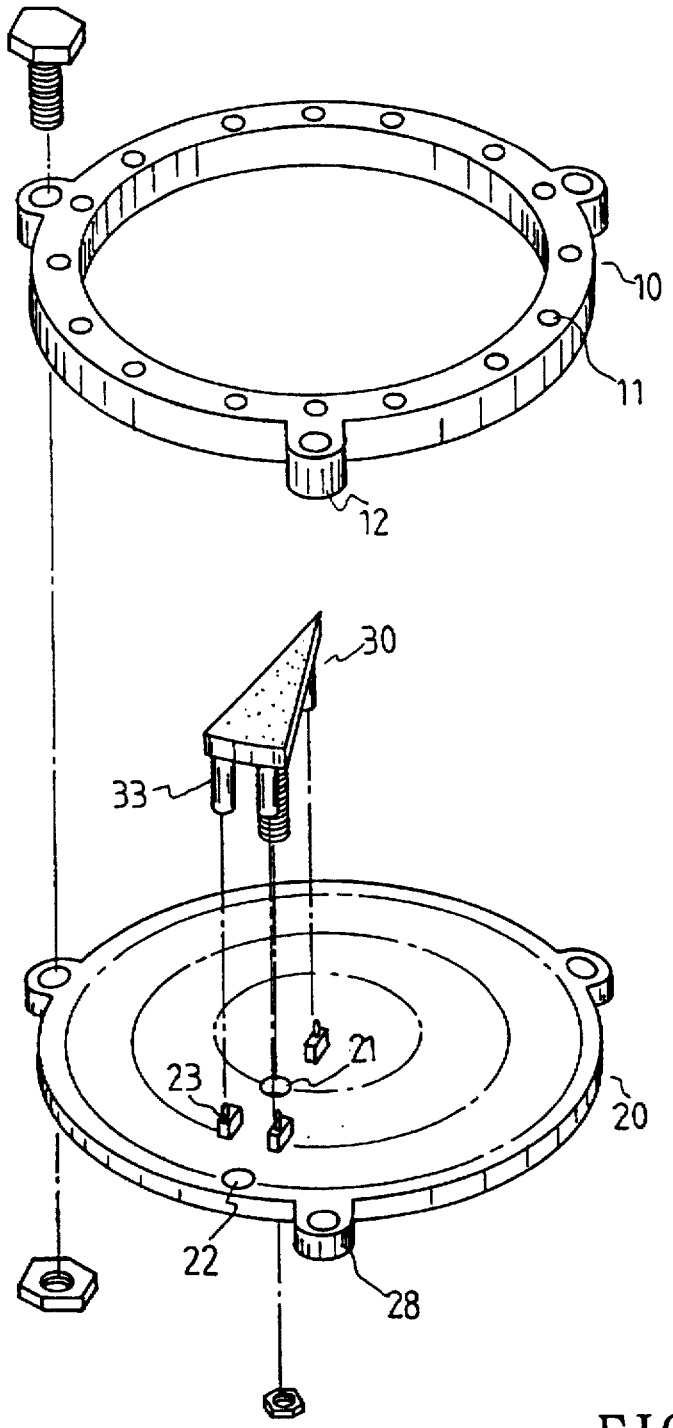
FIG. 3 is an exploded view of the electronic dart board of the invention.
Figure 5:
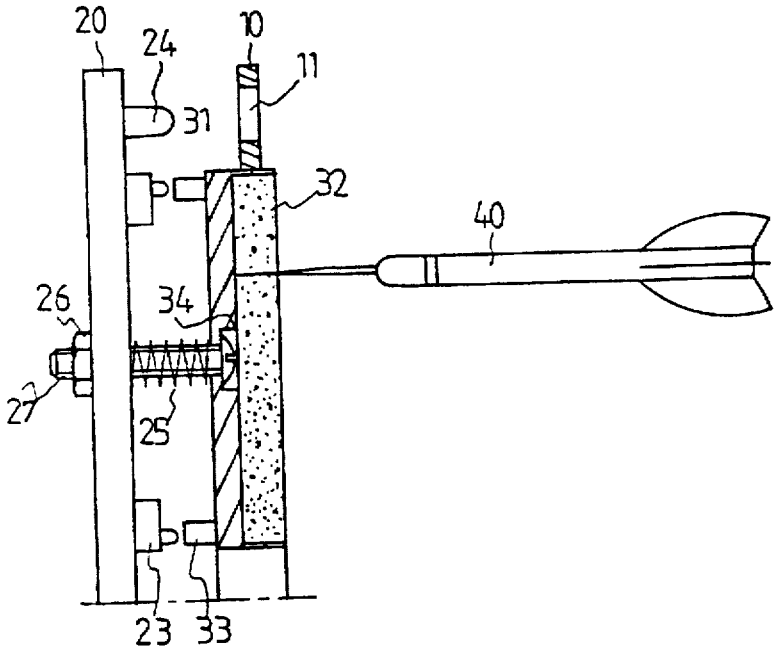
FIG. 5 is a sectional view of the electronic dart board of the present invention, taken along the line A—A of FIG. 2.

Referring to FIGS. 2 and 3, the electronic dart board of the present invention mainly comprises a target frame 10, a base plate 20 and a plurality of target plates 30. The target frame 10 has a plurality of fixing tabs 12, and the base plate 20 has a plurality of fixing tabs 28, which are aligned with the fixing tabs 12, when the target frame 10 is laid on the upper side of the base plate 20. In this manner the target frame 10 and the base plate 20 are fixed to each other. The target frame 10 has on its upper side a plurality of display shields 11. An illuminator 24, shown in FIG. 5 is inserted in a positioning hole 22 on the base plate 20. The display shields 11 allow the illuminator 24 to be visible through the target frame 10. On the inner periphery of the target frame 10, target plates 30 are mounted. They may be of polygonal shape but various shapes for the target plates 30 are possible.

Figure 4:
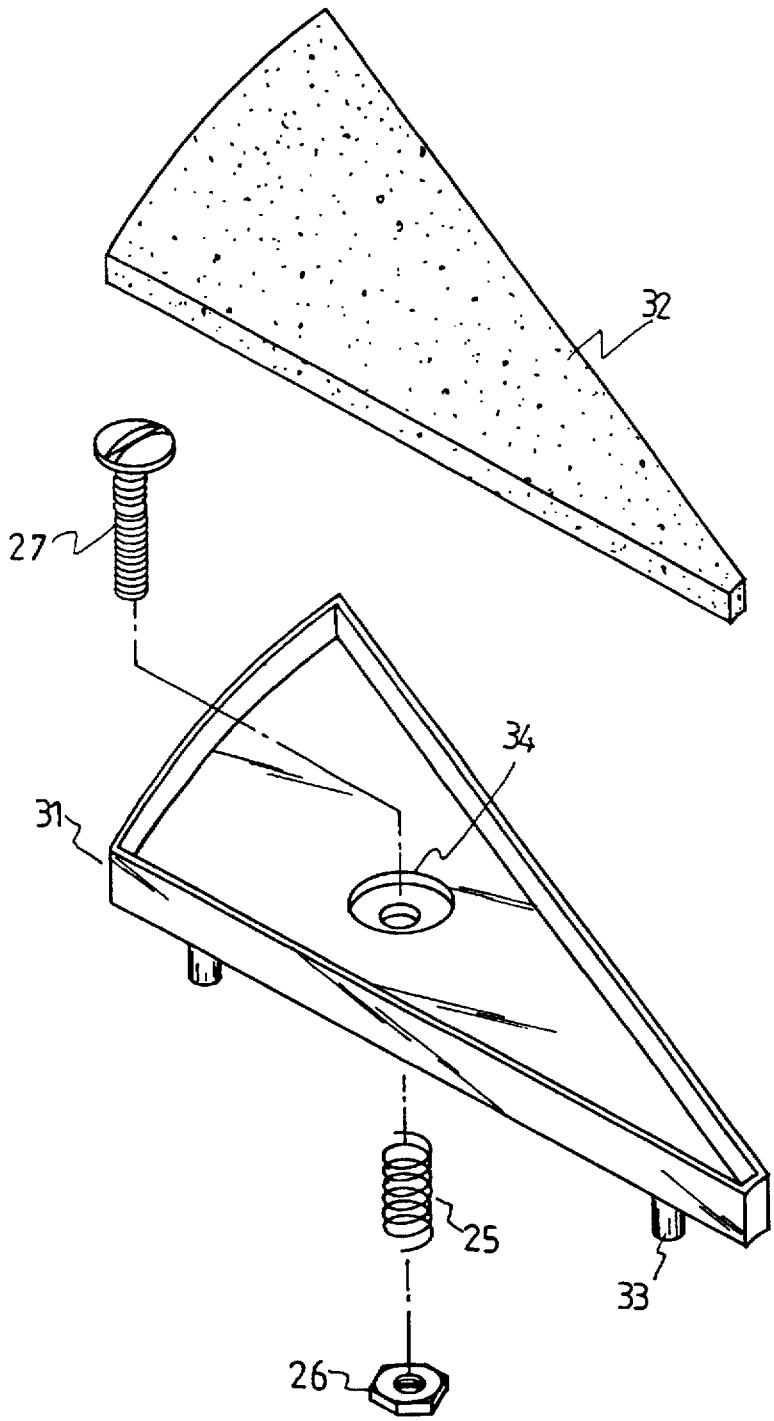
FIG. 4 is an exploded view of a target plate in the electronic dart board of the invention.

As shown in FIGS. 3 and 4, each target plate 30 comprises a press cover 31 and soft body 32. The soft body is glued to the inner border of the press cover 31 and is surrounded by a rim on the periphery of the press cover 31.

From the lower side of the press cover 31, close to the periphery thereof, press bars 33 extend downwards. The press bars point to membrane switches 23, which are attached to the upper surface of the base plate 20. When the target plate 30 is pressed down, towards the base plate 20, the press bars 33 act on the membrane switches 23, causing the illuminator 24 to be turned on. In the middle of the surface of the target plate 30, a fish eye hole 34, is bored through. A screw 27 passes through the fish eye hole 34 further through a spring 25 below the fish eye hole 34 and a through hole 21 in the base plate 20. A nut 26 holds the lower end of the screw below the base plate 20.

Referring to FIG. 5, when a dart 40 hits the soft body 32, the press cover 31, due to the elastic force of the spring 25, sways back and forth, so that at least one of the press bars 33 touches one of the membrane switches 23, causing the illuminator 24 to give off light.

Figure 6:
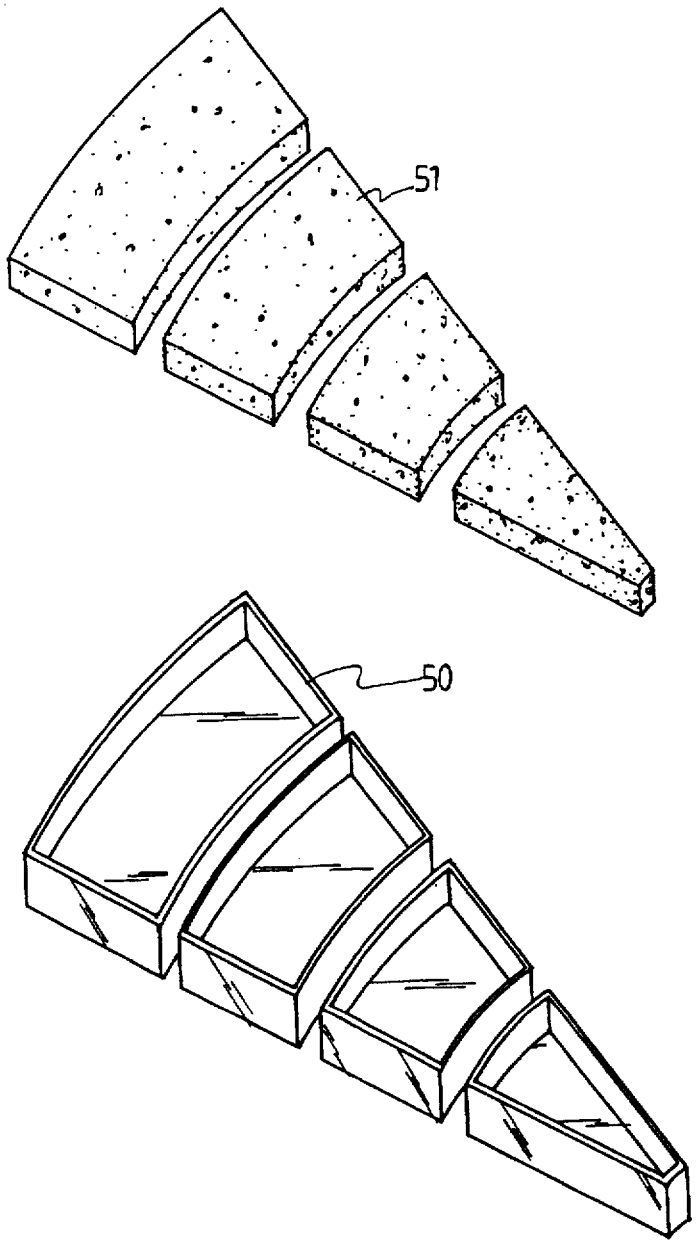
FIG. 6 is an exploded view of a target plate of the electronic dart board of the invention in another embodiment.

Referring to FIG. 6, the electronic dart board of the present invention in another embodiment has target plates, each of which comprise several press covers 50 and soft bodies 51 of different sizes. Each of the soft bodies 51 fits on one press cover 50. Thereby various scores can be introduced into the game, adding to the fun of it.

What is claimed is:

1. An electronic dart board, comprising:

a target frame (10) of ring-like shape, having a middle opening, a front surface and a periphery, a plurality of display shields (11) on said front surface, passing through said target frame, and a plurality of fixing tabs (12) around said periphery;

a plurality of target plates (30) inside said middle opening of said target frame, each of said target plates (30) having a press cover (31) (50), each press cover having an upper side, a lower side and a periphery, a soft body (32) on said upper side of said press cover, a plurality of fish eye holes (34), passing from the middle of said upper side of said press cover to said lower side of said press cover, a plurality of press bars (33), extending downwards from said lower side of each of said press covers close to said periphery thereof; and a base plate (20), carrying said target frame (10) and said target plates (30), said base having a plurality of through holes (21), each of said through holes said base plate being aligned with one of said fish eye holes (34), a spring (25) laid in between each of said fish eye holes (34) and each of said through holes (21) so as to connect said target plates to said base plate elastically, said base plate (20) having a touch-sensitive switch, each of said press bars (33) of each of said plurality of target plates pointing towards each touch-sensitive switch on said base plate, said base plate further having a plurality of illuminators (24) which are aligned with said display shields, whereby said illuminators are not covered by said target frame, said base plate having a plurality of fixing tabs (28) which are aligned with said fixing tabs of said target frame is fastened to said base plate, whereby, when a dart hits one of said target plates, said hit target plate is pushed towards said base plate and at least one of said press bars of said hit target plate touches one of said touch-sensitive switches and a score is indicated.

2. The electronic dart board according to claim 1, wherein said touch-sensitive switches are membrane switches.

3. The electronic dart board according to claim 1, wherein on said periphery of each of said press covers a rim extends upwardly, bordering one of said soft stuffings.

* * * * *